US005490702A

United States Patent [19]

Fleming

[11] Patent Number: 5,490,702

[45] Date of Patent: Feb. 13, 1996

[54] FASTENING TOOL FOR ENGAGING IN A CHANNEL OF A CONCRETE BLOCK

[76] Inventor: Thomas E. Fleming, 1144 - 16th Ave., Clarkston, Wash. 99403

[21] Appl. No.: 377,354

[22] Filed: Jan. 24, 1995

[51] Int. Cl.[6] ..... B66C 1/54

[52] U.S. Cl. ..... 294/97; 294/62

[58] Field of Search ..... 294/15, 16, 62, 294/63.1, 86.24, 93, 95, 97, 115

[56] References Cited

U.S. PATENT DOCUMENTS

| | | | |
|---|---|---|---|
| 2,216,676 | 10/1940 | Ragland | 294/86.24 |
| 2,670,233 | 2/1954 | Barchoff | 294/97 |
| 2,823,948 | 2/1958 | Horton | 294/97 |
| 3,033,605 | 5/1962 | Morrow | 294/97 |
| 3,057,651 | 10/1962 | Lloyd | 294/62 |
| 3,088,769 | 5/1993 | Richardson | 294/93 |
| 3,104,126 | 9/1963 | Lovash | 294/97 |
| 4,095,834 | 6/1978 | Strauss | 294/97 |
| 4,285,538 | 8/1981 | Luke | 294/97 |
| 4,460,210 | 7/1984 | Miechur | 294/97 |
| 4,474,400 | 10/1984 | Toffolon | 294/97 |
| 4,705,312 | 11/1987 | Vooge et al. | 294/97 X |

FOREIGN PATENT DOCUMENTS

| | | | |
|---|---|---|---|
| 1408965 | 7/1965 | France | 294/97 |
| 2022283 | 11/1971 | Germany | 294/97 |
| 2653316 | 6/1978 | Germany | 294/97 |
| 438781 | 1/1975 | U.S.S.R. | 294/97 |
| 1654228 | 6/1991 | U.S.S.R. | 294/97 |

*Primary Examiner*—Johnny D. Cherry
*Attorney, Agent, or Firm*—Keith S. Bergman

[57] ABSTRACT

A tool to releasably engage in a channel of a concrete block for lifting provides an elongate body rod defining a fastening loop in its upper portion and carrying in its lower portion two radially extending fins having an obtuse central angle less than a straight angle therebetween. Each fin pivotally supports vertically spaced, parallel connector links that pivotally interconnect vertically orientated fastening arms for similar radial motion. The body provides at least one fixed fastening arm extending on a line bisecting the central angle between the two fins. Release mechanism provides a release collar slidable on the body between the fins and fastening ring. The collar pivotally carries connector links that interconnect with the upper fastening arms to radially move the fastening arm responsive to collar motion. A compression spring carried about the body rod between the collar and the fastening ring biases the collar downwardly and responsively the fastening arms outwardly. The biasing force is related to the tool weight so that in relaxed condition the fastening arms interconnect within a block channel, but when the tool is lifted by the release collar the fastening arms move to release interconnection within a block channel.

8 Claims, 3 Drawing Sheets

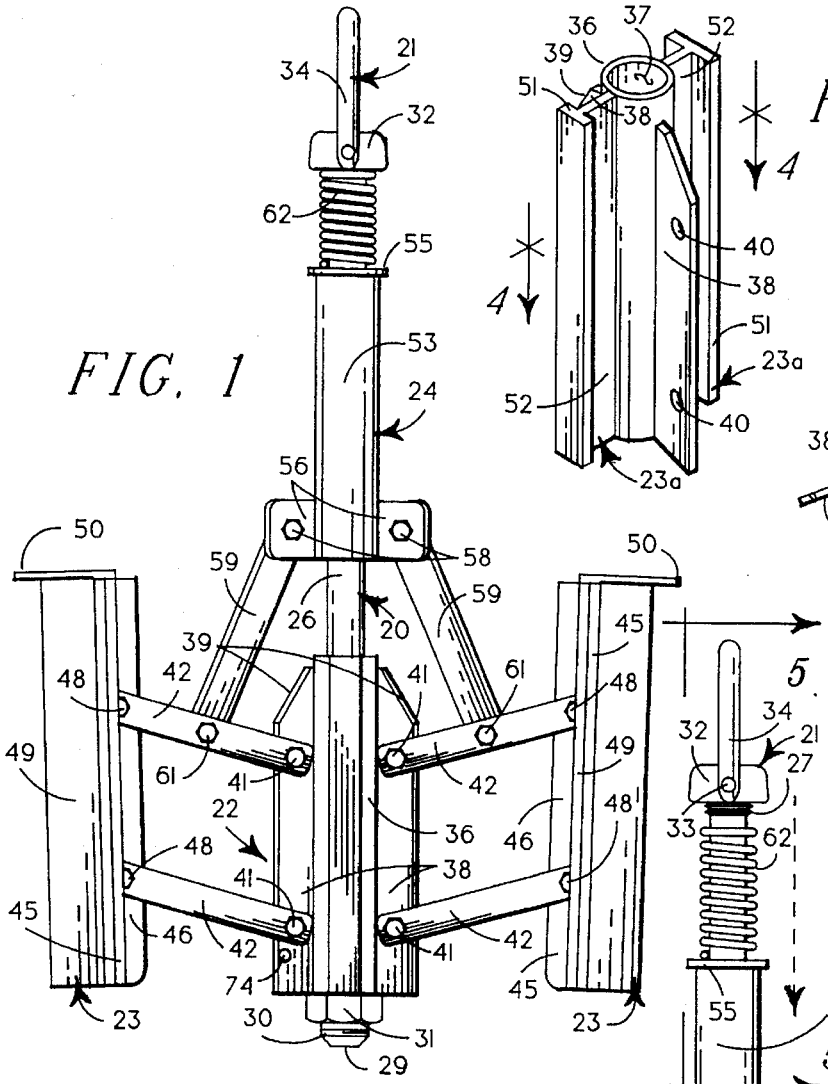
FIG. 1
FIG. 3
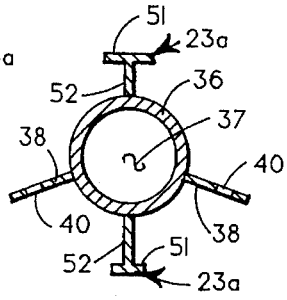
FIG. 4
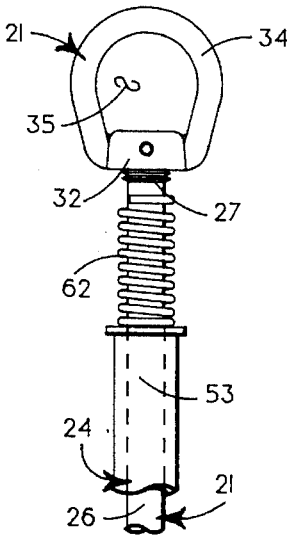
FIG. 5
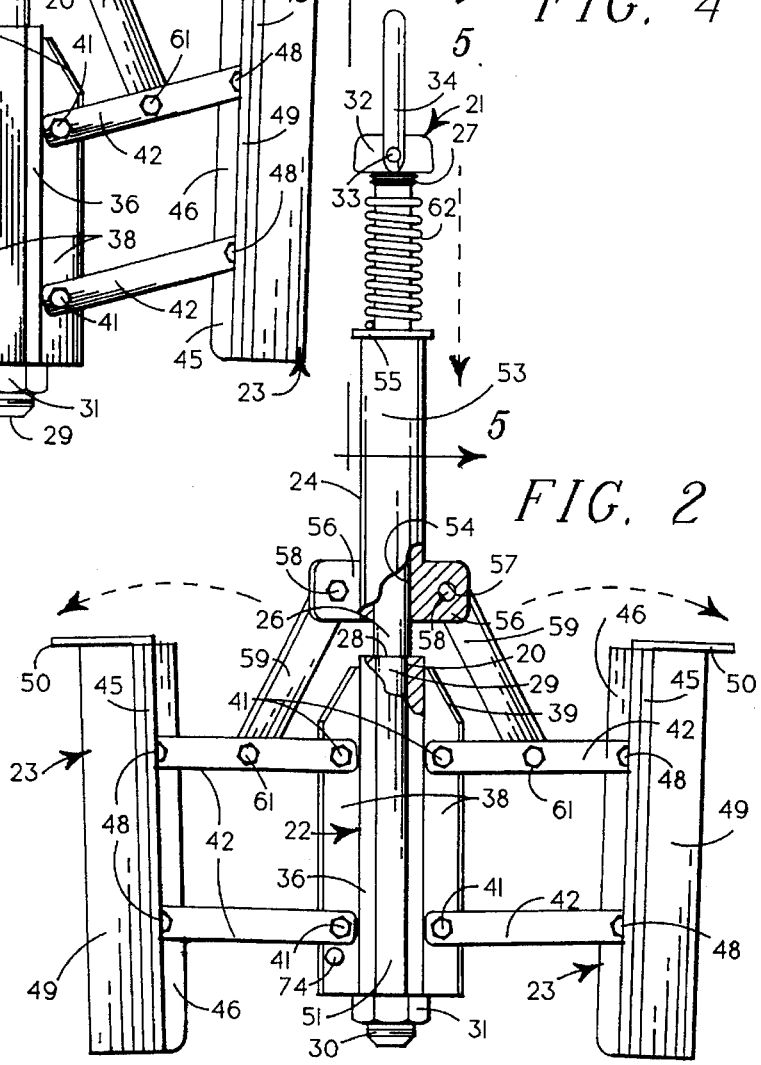
FIG. 2

60
59
60
44
43
42
43
36
37
52
39
51
38
52
40
51
38
23a
40
22
74
72a
70
72
72a
73
73
72a
68
69
25
67
71

23
45
47
49
46

23
50
45
49
46
49
49

10
50

23
46
9
47
45
9
49
47
10
23
69
72a
21
68
67
73
23a
23a
72
73
72a
68
72a
69
50

Bottom View

FASTENING TOOL FOR ENGAGING IN A CHANNEL OF A CONCRETE BLOCK

BACKGROUND OF INVENTION

Related Applications

There are no applications related hereto heretofore filed in this or any foreign country.

Field of Invention

This invention relates generally to tools that releasably engage within a channel defined in a concrete block to provide fastening linkage and particularly to such a tool that has two angulated, radially movable fastening arms and one fixed fastening arm, and is particularly adapted to lift asymmetrical construction blocks.

Background and Description of Prior Art

Various tools for releasably gripping construction blocks to provide a fastening means for lifting or moving the blocks have become known. These devices are generally divisible into a first class that engages and fastens about the external surface of a block such as the typical tong-type devices, and a second class that engages within a channel or orifice defined in the block to expand to engage the orifice walls with sufficient force for support. The instant tool provides a new and novel member of the second class of such tools.

Tools of the first class are often not functionally effective to move blocks from an amassed array of blocks, because by their nature they require access to some peripheral portion of a block for fastening. In an amassed array of blocks, however, other blocks will always be adjacent some external surface of a given block so that the block may have to be moved to allow attachment of a gripping tool, depending upon the nature of the fastening tool and the way in which it fastens upon a block. This often requires difficult manual labor for use of such a tool and substantially limits its practical utility and economic use to readily distinguish tools of the first class from those of the second class.

Most tools of the second class provide two or more expansile fastening arms that are symmetrically carried by a medial shaft about which they move to accomplish their expansion. This type of gripping device is effective with blocks having both an orifice and block body that are symmetrical about to be axis of the shaft, but if the orifice is not symmetrical, such devices normally are not operative and if the block is not symmetrical, unequal forces will be generated in the fastening arms and the block will tip from a horizontal orientation when it is suspended, or both, depending upon the nature of the asymmetry.

The instant gripping tool in distinction was created specifically to grip blocks that are asymmetrical about the vertical lifting axis through the tool and that define channels that are asymmetrical about thins axis. To accomplish this end, the tool provides two radially movable fastening arms that are angulated to each other, with an obtuse central angle that is less than a straight angle, and with at least one other fixed fastening arm extending along a line bisecting the central angle between the expansile arms, preferably extending in the direction of the greater asymmetrical mass. This structure provides the necessary frictional contact of the expansile arms for releasable gripping, but maintains equal forces on the movable arms and lessens angulation of the block to the vertical when lifted.

The method and manner of engaging the walls defining cavities in concrete blocks in known gripping devices have presented various problems. Some devices have provided fastening structure that extends outside the bottom edge of the cavity and over the lower surface of a block about portions of the cavity periphery, but such structures are not practically operative to lift blocks in a stacked array where the bottom of one block is immediately adjacent the top of another, as the top block would have to be moved to allow such a gripping device to extend beneath its undersurface. Another type of gripping device has provided a "U" type bracket that fastens over an upper edge portion of a block by moving in a skewed relationship thereto, but this type of fastening is not sure and secure and often creates forces on thinner edge portions of a block that may cause random breaking or cracking to damage the block and releases the grip of the holding device thereon.

Other types of channel gripping devices have provided extensile arms that frictionally engage vertical surfaces defining block channels. Most such devices have provided hard, low-friction contacting surfaces of small contact area, with or without protuberances, that require substantial forces to create sufficient friction to grip a block. Such forces and the nature of their application often are sufficient to crack, break or damage blocks during the gripping process and, especially in cases where the blocks have pre-existing fracture planes, the forces may cause block damage by breaking portions therefrom and may unexpectedly release the block during lifting or moving operations.

The instant gripper resolves these problems in blocks where they may exist by providing resiliently deformable pads on the block contacting surfaces of fastening arms which not only increase the frictional contact with block surfaces, but also serve to distribute forces over larger areas and to equalize those forces more evenly over those areas to prevent block damage and promote security of block gripping.

Prior expansile arm block gripping tools have presented problems with the simplicity and ease with which they may be inserted in, attached to and removed from the blocks. Prior tools have often required substantial manual manipulation for both engagement in and release from a block which takes significant amounts of time and renders the block lifting process labor intensive and relatively inefficient. The instant gripping tool resolves this problem by providing two fastening arms that expand similarly in a radial fashion from a central rod responsively to motion of a release collar slidably carried on the rod. The collar is spring-biased to a position toward the fastening arms to cause fastening arm expansion, but yet allow radially inward motion of the fastening arms when the tool is lifted by the fastening collar. This mechanism allows simple and easy release of the fastening arms from a fastening position merely by picking up the gripping tool by the fastening collar, but yet automatically causes fastenable engagement in a block orifice when the support of the fastening collar is released.

Many concrete blocks of the modern construction industry, and especially those that are used for retaining walls, define one or more internal channels that are elongate in shape with symmetry about one vertical plane but asymmetry about a perpendicular vertical plane therethrough. Generally such blocks require placement in a horizontal orientation, and this is especially critical with wall forming blocks that are joined by pins or similar connectors that extend between blocks to positionally maintain vertically adjacent blocks. Prior block gripping tools that have provided symmetrically arrayed expansile arms may lift such blocks, depending upon the symmetry of a channel about a vertical axis perpendicular to its center, but in the case of asymmetrical blocks even if the blocks are lifted, they usually will substantially angulate from the horizontal as the center of mass generally will be spaced from the geometrical center of the lifting orifice. The instant invention treats this problem by providing two angulated extensile fastening arms and at least one fixed arm extending along a line bisecting the central angle between the movable arms, so that an asymmetrical block with an asymmetrical opening may be lifted and maintained in a more horizontal orientation during the entire lifting and subsequent placement process.

My invention resides not in any one of these features per se, but rather in the synergistic combination of all of its structures that necessarily give rise to the functions flowing therefrom as herein specified and claimed.

SUMMARY OF INVENTION

My gripping tool provides a body rod carrying in its upper end a fastening hook and in its lower portion two angulated radially extending fins for attachment of extensile fastening arms and at least one fixed fastening arm extending radially along a line bisecting the central angle between the fins or in other symmetrical array between the fins. Each fin pivotally carries two similar, vertically spaced fastening arm connector links, each pair of which pivotally carry in their end portions a vertically elongate fastening arm having a bracket in its upper end to prevent passage through the channel of a block and may have frictional pads on its block contacting surface to aid frictional gripping. A fastening collar, slidably carried by the body rod between the fins and upper fastening hook, provides two fastening ears extending parallel to the body fins and pivotally carrying connecting links that pivotally interconnect with the adjacent fastening arm or the associated upper fastening arm connecting link. A compression spring, carried about the body rod between the fastening collar and upper fastening link, biases the fastening collar to a downward position and thusly the fastening arms to a radially outward position. The spring provides such bias that when the tool is supported by the fastening collar, the weight of the tool supported by the body rod moves the fastening arms to a radially inward, non-fastening position.

In providing such a device, it is:

A principal object to provide a tool having two angulated radially extensile fastening arms and at least one symmetrically related fixed fastening arm to fastenably engage within an asymmetrical concrete block channel to provide gripping means for lifting and moving the block.

A further object is to provide such a tool that will grip a concrete block having symmetry about one vertical plane through the center of a fastening orifice and asymmetry about a perpendicular vertical plane, while maintaining the block in a somewhat horizontal orientation with equal, non-torquing forces on the fastening arms and their support structure.

A further object is to provide such a tool that has a medial body rod carrying the fastening arms with a fastening collar slidable on the rod above the fastening arms to move these arms from a spring-biased, radially extended fastening position to a radially inward non-fastening position by reason of the weight of the structure supported by the body rod when the tool is supported by the fastening collar.

A still further object is to provide such a tool that is of new and novel design, of rugged and durable nature, of simple and economic manufacture and otherwise well adapted for the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement, with only one preferred and practical embodiment being illustrated in the accompanying drawings as required.

BRIEF DESCRIPTION OF DRAWINGS

In the accompanying drawings which form a part hereof and wherein like numbers of reference refer to similar parts throughout:

FIG. 1 is an orthographic elevational view of a first species of my tool showing its various parts, their configuration and relationship in non-fastening position.

FIG. 2 is an orthographic elevational view similar to that of FIG. 1, but with a portion cut away and the fastening arms extended into fastening position.

FIG. 3 is an isometric view of the body structure of the tool of FIG. 1.

FIG. 4 is a horizontal cross-sectional view through the body structure of FIG. 3, taken on the line 4—4 thereon in the direction indicated by the arrows.

FIG. 5 is a partial orthographic view of the upper fastening loop structure of FIG. 2, taken on the line 5—5 thereon looking from the right of that Figure.

DESCRIPTION OF THE PREFERRED EMBODIMENT

Figures 6, 7, 8, 9, 10, 11:
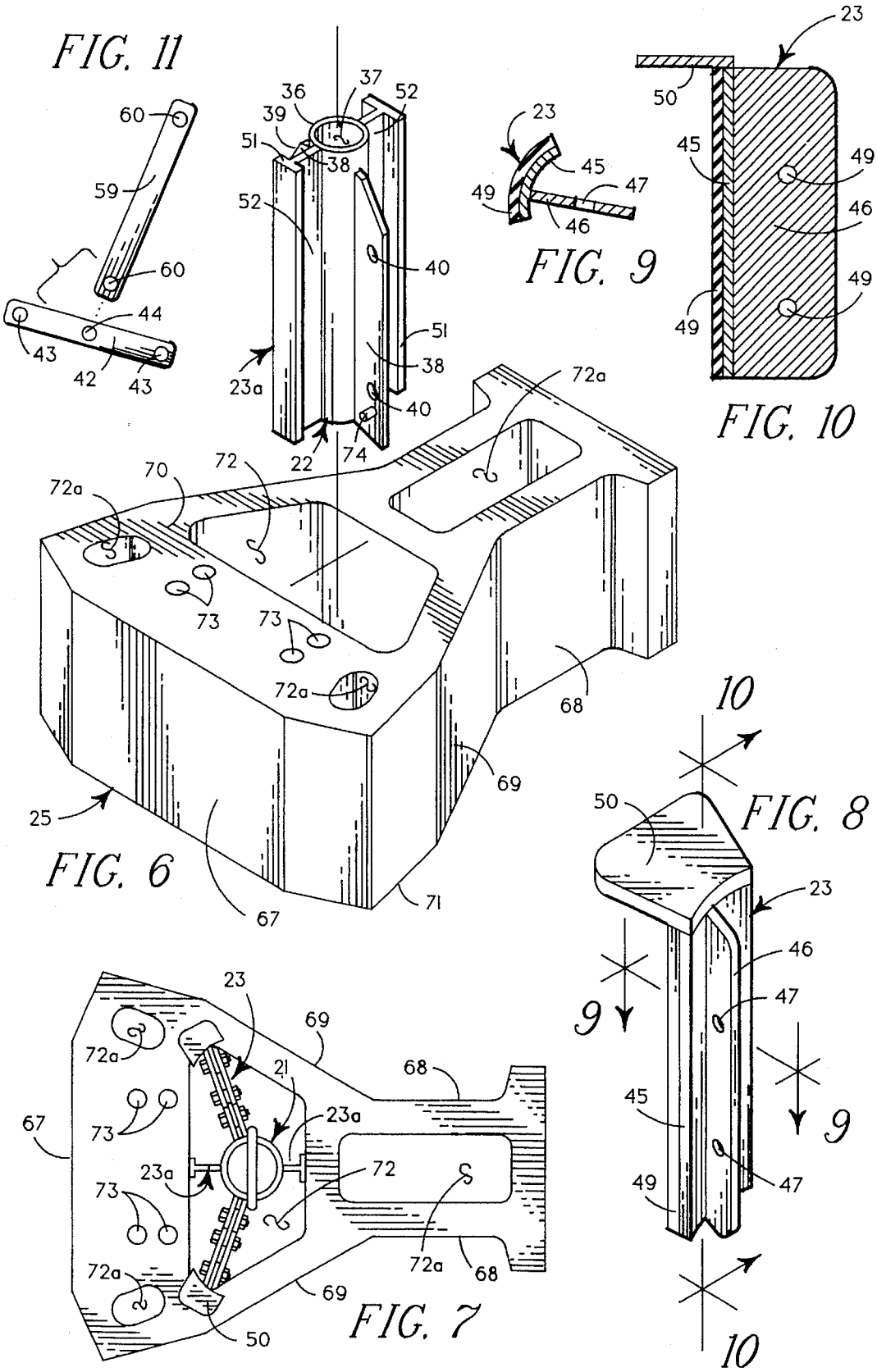
FIG. 6 is an isometric view of the body structure of FIG. 3 in vertical position above the fastening channel of a typical asymmetrical concrete block commonly used to form retaining wails.
FIG. 7 is an orthographic top view of the fastening tool of FIG. 1 in fastening position in the fastening channel of the block of FIG. 6.
FIG. 8 is an isometric surface view of a fastening arm of the tool of FIG. 1, isolated to show its details.
FIG. 9 is a horizontal cross-sectional view through the fastening arm of FIG. 8, taken on the line 9—9 thereon in the direction indicated by the arrows.
FIG. 10 is a vertical cross-sectional view through the fastening arm of FIG. 8, taken on the lane 10—10 thereon in the direction indicated by the arrows.
FIG. 11 is an expanded orthographic view of a fastening arm connector link and its associated release connector link.

My tool generally provides central body rod 20 carrying in its upper portion lifting ring 21 and in its lower portion optional body 22 and plural fastening arms 23 and release mechanism 24 that move to selectively interconnect the tool in a channel of block 25.

In the first species of FIGS. 1–11, central body rod 20 is an elongate element defining medial cylindrical portion 26 communicating between upper threaded portion 27 and lower body shoulder 28. The portion of the body rod extending below body shoulder 28 is diametrically smaller than the medial cylindrical portion 26 and defines threaded lower end portion 30 to fastenably engage within nut 31 to fastenably maintain the body between the body shoulder and the nut. It also is within the scope of my invention to fixedly attach the body on the body rod by welding.

Lifting ring 21 provides medial cylindrical body 32 defining an internally threaded channel to fastenably receive the upper threaded portion 27 of the body rod. The body 32 defines perpendicular, radially extending holes to receive pin 33 to positionally maintain a fastening ring in either of the two perpendicular positions. Upwardly extending "U" shaped fastening ring 34 is carried by pin 33 to define with the body a peripherally enclosed orifice 35 to accept a fastening means (not shown) provided by a lifting device to allow interconnection with my tool. The fastening loop 34 preferably is joined in a pivotal manner.

Body 22 provides medial cylindrical portion 36 defining an axially aligned internal channel 37 to receive the medial portion 29 of the body rod therethrough. The axial length of medial cylindrical portion 36 is such that it will fastenably extend between the lower body shoulder 28 and nut 31 when engaged on the body rod. The medial cylindrical portion of the body carries two radially extending fastening fins 38 that are angulated to each other with an obtuse central angle that is less than a straight angle. The fins 38 have truncated upper outer portions 39 so as not to interfere with operation of connector links of the release mechanism and extend radially a distance sufficient to allow interconnection with fastening arm connecting links. Each fin 38 defines two vertically spaced fastening holes 40 to receive nut-bolt fasteners 41 to pivotally interconnect the fastening arm connector links.

Fastening arm connector links 42, as seen in FIG. 11, are similar elongate rigid bar-like elements defining fastener holes 43 inwardly adjacent each end. The radially inner end portions of an opposed pair of connector links 42 are pivotally fastened to each fin 38 by nut-bolt fasteners 41 extending therebetween. The length of the connector links is such that when they are in a position extending perpendicularly to the axis of central rod 20, fastening arms carried thereby will fastenably engage within the channel of a block to be gripped. The medial portion of each upper connector link defines a third fastener hole 44 to interconnect links of the release mechanism.

Body 22 carries two movable fastening arms 23 and at least one fixed fastening arm 23*a*. The movable fastening arms, shown particularly in FIGS. 8–10, provide vertically elongate fastening body 45, of an arcuate horizontal cross-sectional shape structurally interconnecting radially inwardly extending fastening fin 46. The fastening fin 46 defines in its medial portion two vertically spaced fastener holes 47 that have the same distance between their centers as the fastener holes 40 defined in the fins 38 of body 22. These fastener holes 47 carry nut-bolt fasteners 48 that extend through the radially outer fastener holes 43 in fastener arm connector links 42 to pivotally mount the movable fastening arms on the body.

It is to be noted from the positioning of the fastener holes in the body fins 38 and the fastener arm fins 46 that both upper and lower connector links 42 will be parallel and thusly will similarly move both movable fastening arms in a radial direction while maintaining the vertical orientation of the fastening arms. The fastening arm connector links are prevented from moving downwardly below a horizontal position perpendicular to the body 22 by at least one pin 74 carried by one fin 38 immediately below the fastening arm.

The radially outer surface of the arcuate fastening body 45 of each fastening arm 23 carries a frictional cover 49, preferably formed of rubber or an elastic polymer. The upper edge of each fastening body 45 carries a radially outwardly extending stop bracket 50 to extend over the upper surface about the periphery of a block channel to be gripped to prevent the movable fastening arms from moving into a channel beyond the top of the movable fastening arms. Preferably the movable fastening arms vertical length below elements 45 is not greater than the length of a channel within which they are to be placed, so that they will not extend below the lower surface of a block to be lifted.

Fixed fastening arm 23*a* provides vertically elongate fastening body 51 of a rectilinear configuration and of substantially the same vertical length as fastening body 45 of the movable fastening arm. The fastening body 51 structurally interconnects to fastening fin 52 which in turn is structurally interconnected to medial cylindrical portion 36 of the body 22. The fastening fin 52 is of rectilinear shape and extends radially from the body along a line bisecting the central angle between the fastening fins 38. If only one fixed fastening arm is used, it preferably should extend from the body in the direction away from the center of mass of an asymmetrical block and the amount of radial extension of either one or two fixed fastening arms, if used, should be incrementally less than the distance to the adjacent wall surface defining a channel in a block to be gripped. The purpose of the fixed fastening arms is not to provide any fastenable contact with a block to be lifted, but rather to provide support to prevent bending moments in the movable fastening arms which may damage the lifting tool or prevent its functioning. It is possible that more than two differently positioned, fixed fastening arms may be used with my tool, and this is within its scope.

Release mechanism 24 provides cylindrical release collar 53 defining internal channel 54 for slidable carriage on medial cylindrical portion 26 of the body rod 20. The top of the release collar 53 structurally carries diametrically larger annular cap disk 55 to aid in preventing a user's hand from slipping upwardly off the release collar. The axial length of the release collar is less than the distance between the upper portion of body 22 and the lower portion of lifting ring 21 and preferably about half of this distance. The lower portion of the release collar 53 carries opposed radially extending fastening ears 56, each arrayed in the same angular relationship as the fins 38 of the body. Each fastening ear defines a medial fastening hole 57 to receive nut-bolt type fasteners 58.

The fastening ears 56 pivotally mount elongate rigid bar-like release links 59 defining fastener holes 60 inwardly adjacent each end for fastening. In this first species of my tool the release links extend to the medial portion of the upper fastening arm connector links 42 where they are pivotally joined by nut-bolt type fasteners 61 extending through fastener holes 60 in the release connector links and the fastener holes 44 in the upper fastening arm connector links. The length of the release connector links 59 and the distance between the fastener holes 60 are such that the lower portion of the release collar 53 is spacedly above the upper portion of body 22 when the fastening arm connector links 42 are substantially horizontal or perpendicular to the axis of the release collar 53 and body rod 20.

Compression spring 62 is carried about the upper portion of body rod 20 between the cap disk 55 of release collar 53 and the bottom of lifting ring body 32. The axial length of the spring 62 is such that it exerts no bias on the release collar when that collar is in a position such that the fastening arm connector links 42 are perpendicular to the axis of the body rod 20, but it does exert downward biasing force from that point as the release collar 53 is moved upwardly. The biasing force of the spring is such that when the gripping tool is supported by the release collar 53, the spring 62 will compress sufficiently, by reason of the weight of the body rod and elements it supports, to move the fastening arm connector links 42 to an upwardly angled orientation as shown in FIG. 1 and responsively move the fastening arms 23 radially inwardly sufficiently to cause their release from a block channel in which they have been engaged.

The type of block illustrated in FIG. 6 is one commonly used in building retaining wails and is one with which the first species of my gripping device is designed to operate. Such blocks provide a vertical face 67 and a somewhat narrower rearward portion 68, with a medial transition portion 69 communicating therebetween. The medial portion 69 of the block defines at least one primary orifice 72 extending between top 70 and bottom 71 and normally various other secondary orifices **72*a* for drainage, filling with fluidic concrete, and the like. Such blocks generally provide alignment pin holes 73** to allow rigid pins (not shown) to extend between vertically adjacent courses of blocks to aid in fastening those courses relative to each other.

Figures 12, 13, 14:
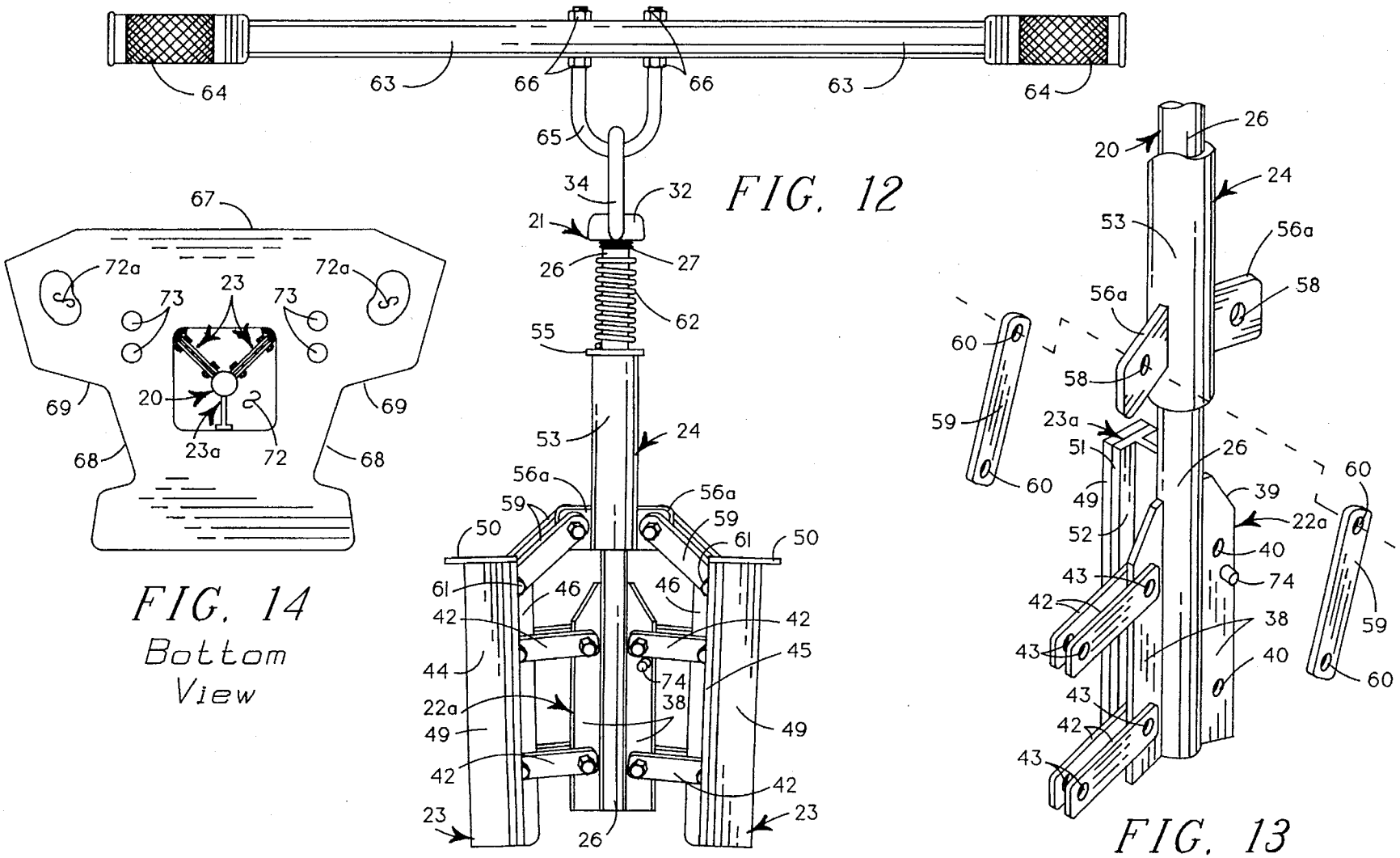
FIG. 12 is an orthographic elevational view of a second species of fastening tool particularly designed for smaller blocks and having a bar handle for manual lifting.
FIG. 13 is a partial, expanded isometric view of the connecting linkage between the fastening structure, central rod and release mechanism of the tool of FIG. 12.
FIG. 14 is an orthographic bottom view of the device of FIG. 12, in fastening position in the channel of a smaller asymmetrical concrete block.

A second species of tool especially for gripping and manually manipulating smaller blocks is illustrated in FIGS. 12–14.

This second species of tool provides a central rod and lifting ring that performs the same functions as those structures of the first species, except structurally the body rod is the same diameter in its medial and lower portions and does not define a body shoulder as there is no need for this element.

The body **22*a* of the second species of my gripping tool does not provide a medial cylindrical portion but rather fins 38 and fixed fastening arm 23*a* are structurally joined directly to the body rod 26 by welding. Both upper and lower fastening arm connector links 42 perform the same functions as those structures in the first species, except that in the second species they are doubled so that one link extends from each side of each fin 38 with an appropriate space between associated links to receive the fastening arm fins 46. The body of this second species provides only one fixed fastening arm 23*a* with its block contacting surface covered with a resilient high friction material 49 such as a harder rubber. The movable fastening arm structure 23** of the second species is the same as that of the first species.

The release mechanism of the second species is substantially similar to that of the first species, except the release links are doubled and interconnect with the fastening arm fin rather than the fastening arm connector links. The fastening ears **56*a* are provided with the same angulation as in the first species, to receive release links 59 on each side to provide additional strength and rigidity. The lower end portion of the release links 59 pivotally connects with the upper inner portion of the associated fastening arm fin 46 by means of nut-bolt fastener 61** extending through holes appropriately defined in the elements.

The reason for the doubling of various linkages interconnecting the members of the tool of this second species is that it may be formed from lighter material and the doubling of various links creates additional strength to assure that all linkages provide the strength and rigidity required of them without causing damage.

Both species of gripping tools and the blocks which they grip may be manually manipulated by two workmen. To aid in accomplishing this manipulation, I provide an optional, releasably attachable lifting bar 63 as shown in FIG. 12. This bar has resilient handle grips 64 at each end and carries depending "U" bolt 65 in its medial portion. The "U" bolt legs extend through holes defined in the lifting bar and are positionally maintained in releasable interconnection therein by spaced cooperating nuts 66 on each side of the bar. The "U" bolt is interconnected within fastening loop 34 of the lifting ring as illustrated to allow manual lifting, transport and positioning of a block after establishment of my tool therein.

The type of block illustrated in FIG. 14 for which the second species of my gripping tool is particularly designed to operate, provides the same essential features as the block of FIG. 6, though some features are of somewhat different configuration. This second block species is used in smaller wall structures than the block of FIG. 6 and in general is dimensionally smaller and of less mass than the block of the first species. The primary orifice 72 of the block of FIG. 14 is also of somewhat different horizontal cross-section.

A particular gripping tool of either species of my invention is dimensioned to fastenably engage within the primary orifice of a block to be lifted, though most blocks of modern day construction are reasonably standardized in configuration and dimension according to the two types illustrated. Most minor variations may be accounted for within the limits of motion of my tool.

Having thusly described the structure of my invention, its use may be understood.

To use a tool of the first species, it is formed according to the foregoing specification and picked up by a workmen by grasping release collar 53. As this occurs, the weight of the tool supported on body rod 20 will cause the body rod to move somewhat downwardly relative to the release collar and create bias in the compression spring 62 between the release collar and lifting ring body as shown in FIG. 1. In this condition, the fastening arms 23 will be moved somewhat radially inwardly toward the body rod 20 by reason of the angularly upward motion of the radially outer portions of the upper fastening arm connector links 42 caused by the motion of the release collar 53 relative to the body rod 20.

The tool in this condition is manually moved over and above the channel 72 of a concrete block 25 to be lifted, and the lower portion of the tool is inserted within the channel of that block and moved downwardly therein. The downward motion of the tool will be stopped when top brackets 50 of the movable fastening arms 23 contact the upper surface of the block about the periphery of channel 72 and at this point, the workman releases his grasp upon the tool. As this occurs and the tool is supported by the block, the bias of compression spring 62 moves the release collar 53 downwardly on the body rod 20 toward the body 22 and this responsively moves the movable fastening arms 23 radially outwardly to come into contact with vertical walls defining the block channel 72.

The tool will have been configured so that the fixed fastening legs **23*a* will be substantially in contact with other surfaces of the channel 72 to stabilize the positioning of the gripping tool and provide at least three arm support in its orifice. In this condition, a fastening device, such as a hook of a backhoe, small crane or other lifting machine, is attached to fastening loop 34** and that loop is raised upwardly. As the tool is lifted there will be frictional engagement of the movable fastening legs within the orifice of the block, and the weight of the block as it is lifted will merely increase this frictional engagement as the weight will tend to move the fastening arms further radially outwardly and into stronger frictional engagement within the block orifice. The block then is moved to a position vertically above where it is desired that it be positioned.

To position the block, the gripping tool is lowered so that the block is in close proximity, but spacedly above the surface that is to support it. The block is then manually manipulated to bring it into final positional adjustment over its support., and it is lowered to come into contact with an underlying support and be supported by that support. At that point, the workman grasps the tool by the release collar, with or without detachment of the tool from the lifting device, and manually supports the tool by means of the collar. The tool then will return to the condition in which the lifting operation started, with the movable fastening arms moved radially inwardly sufficiently to release gripping contact within the block channel in which it is positioned, and in this condition the tool is lifted from the block and ready for another lifting operation as described.

The lifting operation with the tools of either the first or second species is the same, and in the case of the second species, if the lifting bar be used, the block would be manually manipulated by the bar to cause its lifting rather than by some secondary powered lifting machine.

Such concrete blocks as described commonly heretofore have been set by hand by workmen. This manual operation usually allows the placement of 350 to 450 blocks of the first species per eight hour shift with a crew of four men, or approximately 87 to 112 blocks per man per day of eight hours. With the use of my tool, a backhoe as a lifting machine and two workmen, one to operate the backhoe and one to operate the gripping tool, blocks can be set at a rate of approximately 200 to 250 per hour or 100 to 125 per man hour and 800 to 1200 blocks per man day, depending somewhat upon individual workmen and particular working conditions.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A gripping tool providing fastening means for lifting an object by releasably fastening within a channel defined in the object, comprising in combination:

an elongate body rod carrying lifting means at an upper end and fixedly carrying in a lower portion two radially extending fastening fins with an obtuse central angle less than 180 degrees therebetween, said fastening fins each pivotally carrying a pair of similar vertically spaced fastening arm connector links;

similar movable fastening arms pivotally carried by each pair of fastening arm connector links, each said fastening arm having an outer body with an outer surface to contact a channel defining object surface and means for supporting the fastening arm on the channel defining object and preventing passage through the object channel; and release mechanism including a release collar slidably carried on the body rod between the fastening fins and the lifting means, said release collar having radially extending fastening ears arrayed in the same angular relationship as the fastening fins carried by the body rod, each said fastening ear pivotally carrying a release connector link communicating with an associated fastening arm to move that fastening arm responsive to motion of the release collar.

2. The tool of claim 1 further characterized by:

the fastening fins structurally carried by a cylindrical body carried on the lower portion of the body rod, the release connector links pivotally communicating with the medial portion of each adjacent upper fastening arm connector link, and each fastening arm being pivotally interconnected with the outer end portions of the fastening arm connector links so that each pair of fastening arm connector links are parallel.

3. The tool of claim 1 further characterized by:

the fastening fins being structurally carried by the body rod, the release connector links pivotally communicating with the upper portion of each adjacent movable fastening arm body, and each fastening arm being pivotally interconnected with the outer end portions of the fastening arm connector links so that each pair of fastening arm connector links are parallel.

4. The tool of claim 1 further characterized by:

the outer surface of the outer body of each movable fastening arm having a covering of resilient frictional material to increase frictional contact and distribute forces between the fastening arm body and an adjacent block surface.

5. The tool of claim 1 further characterized by:

a compression spring carried on the body rod between the release collar and the lifting means to bias the release collar downwardly when the release collar is in a position above which the fastening arm connector links extend perpendicularly to the body rod, but allow the release collar to move upwardly against the spring bias when supported by the release collar by reason of the weight of the structure supported by the body rod.

6. The tool of claim 1 further characterized by:

the body rod carrying at least one fixed fastening arm extending radially outward away from and on a line bisecting the central angle between the fastening fins.

7. A gripping tool, for releasably fastening only within a channel defined in a construction block, comprising in combination:

an elongate body rod carrying a lifting ring at an upper end and having a body in the lower portion, said body having two radially extending fastening fins with an obtuse central angle less than 180 degrees therebetween, said fastening fins each pivotally carrying a pair of similar, vertically spaced fastening arm connector links, and supporting at least one fixed fastening arm extending radially outwardly away from and on a line bisecting the central angle between the fastening fins;

similar movable fastening arms carried by each pair of fastening arm connector links, each said movable fastening arm being pivotally interconnected with the outer end portion of the movable fastening arm connector links so that each pair of connector links are parallel, each said movable fastening arm having an outer body having an upper edge and a resilient, friction element at least on its radially outermost surface, and a stop bracket extending radially outwardly from the upper edge of the outer body to provide support on and prevent passage through a block channel;

release mechanism including a release collar slidably carried on the body rod between the lower portion and the lifting ring, said release collar having radially extending fastening ears arranged in the same angular relationship as the fastening fins carried by the body rod, each said fastening ear pivotally carrying a release connector link extending into pivotal interconnection with the medial portion of the adjacent upper fastening arm connector link; and a compression spring carried on the body rod between the release collar and the lifting ring to bias the release collar downwardly away from the lifting ring when the release collar is in a position above which the fastening arm connector links extend perpendicularly to the body rod, but allow the release collar to move upwardly against the spring bias when the tool is supported by the release collar, by reason of the weight of the structure supported by the body rod.

8. A gripping tool for releasably fastening within a channel defined in a construction block, having planar parallel top and bottom surfaces comprising in combination, an elongate body rod carrying a lifting ring at an upper end, two radially extending fastening fins in the lower portion, said fastening fins having an obtuse central angle less than 180 degrees therebetween and each fastening fin pivotally carrying a pair of similar, vertically spaced fastening arm connector links, and at least one fixed fastening arm extending radially outward away from and on a line bisecting the central angle between the fastening fins;

similar movable fastening arms carried by each pair of fastening arm connector links, each said movable fastening arm being pivotally interconnected with the outer end portions of the movable fastening arm connector links so that each pair of connector links are parallel, each said movable fastening arm having an outer body with an upper edge and outer surface, with a resilient frictional element on the outer surface, and a stop bracket extending radially outwardly from the upper edge to provide support on and prevent passage through a block channel; and release mechanism including a release collar slidably carried on the body rod between the lower portion and the lifting ring, said release collar having radially extending fastening ears arrayed in the same angular relationship as the fastening fins of the body rod, each said fastening ear pivotally carrying at least one release connector link extending into pivotal interconnection with the upper portion of the adjacent fastening arm; and a compression spring carried on the body rod between the release collar and the lifting ring to bias the release collar downwardly away from the lifting ring when the release collar is in a position above which the fastening arm connector links extend perpendicularly to the body rod, but allow the release collar to move upwardly against the spring bias when that tool is supported by the release collar, by reason of the weight of the structure supported by the body rod.

* * * * *